US007641573B2

(12) United States Patent
Cech

(10) Patent No.: US 7,641,573 B2
(45) Date of Patent: Jan. 5, 2010

(54) ARTICULATING BATTING TEE

(76) Inventor: Frederick Cech, 844 Olive Branch Ct., Edgewood, MD (US) 21040

( * ) Notice: Subject to any disclaimer, the term of this patent is extended or adjusted under 35 U.S.C. 154(b) by 1044 days.

(21) Appl. No.: 10/947,395

(22) Filed: Sep. 22, 2004

(65) Prior Publication Data

US 2005/0101418 A1 May 12, 2005

Related U.S. Application Data

(60) Provisional application No. 60/504,995, filed on Sep. 22, 2003.

(51) Int. Cl.
*A63B 69/00* (2006.01)

(52) U.S. Cl. ..... 473/417; 473/451

(58) Field of Classification Search ..... 473/417, 473/431, 418–420, 454, 451; 124/5–7
See application file for complete search history.

(56) References Cited

U.S. PATENT DOCUMENTS 4,709,924 A * 12/1987 Wilson et al. ..... 473/417
4,796,885 A * 1/1989 Wright ..... 473/417
5,004,234 A * 4/1991 Hollis ..... 473/417
5,388,823 A * 2/1995 Prieto ..... 473/417

* cited by examiner

*Primary Examiner*—Mitra Aryanpour
(74) *Attorney, Agent, or Firm*—Ober / Kaler; Royal W. Craig

(57) ABSTRACT

A fully articulated batting tee including a first support post with a telescoping stem for height-adjustable support of a baseball. The first support post extends downward from the ball to the ground to provide a first point of ground-support. A lateral support assembly comprises a plurality of lateral struts joined at one end to the first support post and extending laterally therefrom to a second support post. A pivoting coupling is mounted on the second support post, and the coupling includes a plurality of collars for insertion of corresponding struts (each of the collars slidably supports a corresponding one of the lateral struts therein). The second support post extends downward to a practice plate and is anchored thereto, thereby providing a second point of ground-support. The combination of height-adjustment, lateral adjustment and pivoting provide a fully articulating batting tee that can position the ball anywhere over or around the practice plate.

10 Claims, 3 Drawing Sheets

ARTICULATING BATTING TEE

CROSS-REFERENCE TO RELATED APPLICATIONS

The present application derives priority from U.S. provisional application No. 60/504,995 filed 22 Sep. 2003.

BACKGROUND OF THE INVENTION

1. Field of the Invention

The present invention relates to swing-training devices for baseball and softball and, more particularly, to a fully-articulating batting tee that allows the user to position the baseball within a range around home plate.

2. Description of the Background

Hitting a baseball is one of the most difficult athletic feats in sport. Done successfully, the bat will impart a force as high as 8,000 pounds to a ball in a half-millisecond of impact so the ball has sufficient momentum to carry it into the bleachers before gravity pulls it down into the outfielder's glove.

However, a batter facing a 90 mph fastball has less than ¼ of a second to see the pitch, evaluate its speed and location, decide whether or not to swing, and then to execute the swing. To make contact, the bat must meet the ball within an eighth of an inch of dead center and at precisely the right millisecond as the pitch flies by.

There are a variety of existing swing-training devices. One in particular, the batting tee, has found its prominence in the world baseball and softball. Batting tees are commonly used everywhere from the fields of little league baseball to the plush diamonds of major league baseball. Why is the batting tee so commonly used? There are many good treatises on hitting, including *The Science of Hitting* by the Splendid Splinter (Boston Red Sox Hall-of-Famer Ted Williams). Others include Charlie Lau's book *The Art of Hitting*, and Dusty Baker's book *You Can Teach Hitting*. All of these authorities have one thing in common: they advocate the use of a stationary batting tee to familiarize batters with the strike zone and their own swing mechanics, thereby making the correct foregoing decision. Even with all of the technology currently available, the simple batting tee will never be antiquated.

Players most frequently turn to the batting tee for rehabilitation after injury and for review of swing mechanics during prolonged hitting slumps. Prior art batting tees generally include simple base and tube assemblies, with the tube extending vertically from the base. The tube supports a ball in the approximate area of the player's strike zone.

Unfortunately, stationary tees hold the ball in one or a few locations over the center of home plate. This forces the batter to improperly position his or her feet in relation to home plate and to reposition himself or herself every time he wants to adjust to different pitch locations. This action does not lend itself to follow form with the baseball adage, "hit the ball where it is pitched."

Let's consider the swing dynamic. The batter cocks his wrist, rotates his hips, and extends his arms, creating a swing arc. Hitting the ball on the "fat" of the bat along the swing arc requires a swing pattern adjustment. The inside pitch is on the arc in front of home plate and the outside pitch is on the arc at the plate. The arc, in fact, does not originate from home plate, but from the batter's feet. This requires the hitter to consider two factors before executing a proper swing: ball position and feet position in the batters box. The problem with current tee construction is simply that they cannot recreate ball positions along the arc from where the feet are in the batter's box (see FIG. 3).

Thus, it would be greatly advantageous to address this disadvantage with a fully articulating batting tee that can position the ball anywhere over or around home plate.

SUMMARY OF THE INVENTION

It is therefore an object of the present invention to provide a fully articulating batting tee that fully articulates along infinite arc positions around home plate from the batter's position in the batter's box.

It is another object to provide a fully articulating batting tee that facilitates quick and easy adjustment and is easily assembled and disassembled.

It is still another object to provide a fully articulating batting tee configuration that is highly durable and can withstand repeated mishits.

According to the present invention, the above-described and other objects are accomplished by providing a fully articulated batting tee. The tee generally includes a first support post with a telescoping stem for height-adjustable support of a baseball. The first support post extends downward from the ball to the ground to provide a first point of ground-support. A lateral support assembly comprises a plurality of lateral struts joined at one end to the first support post and extending laterally there from to a second support post. This coupling includes a plurality of collars for insertion of corresponding struts (each of the collars slidably supports one of the corresponding lateral struts therein). The second support post extends downward to a practice plate and is anchored thereto, thereby providing a second point of ground-support. The combination of height-adjustment, lateral adjustment and pivoting provide a fully articulating batting tee that can position the ball anywhere over or around the practice plate. The simplicity of design and ease of use serve as a catalyst in developing the science of hitting.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
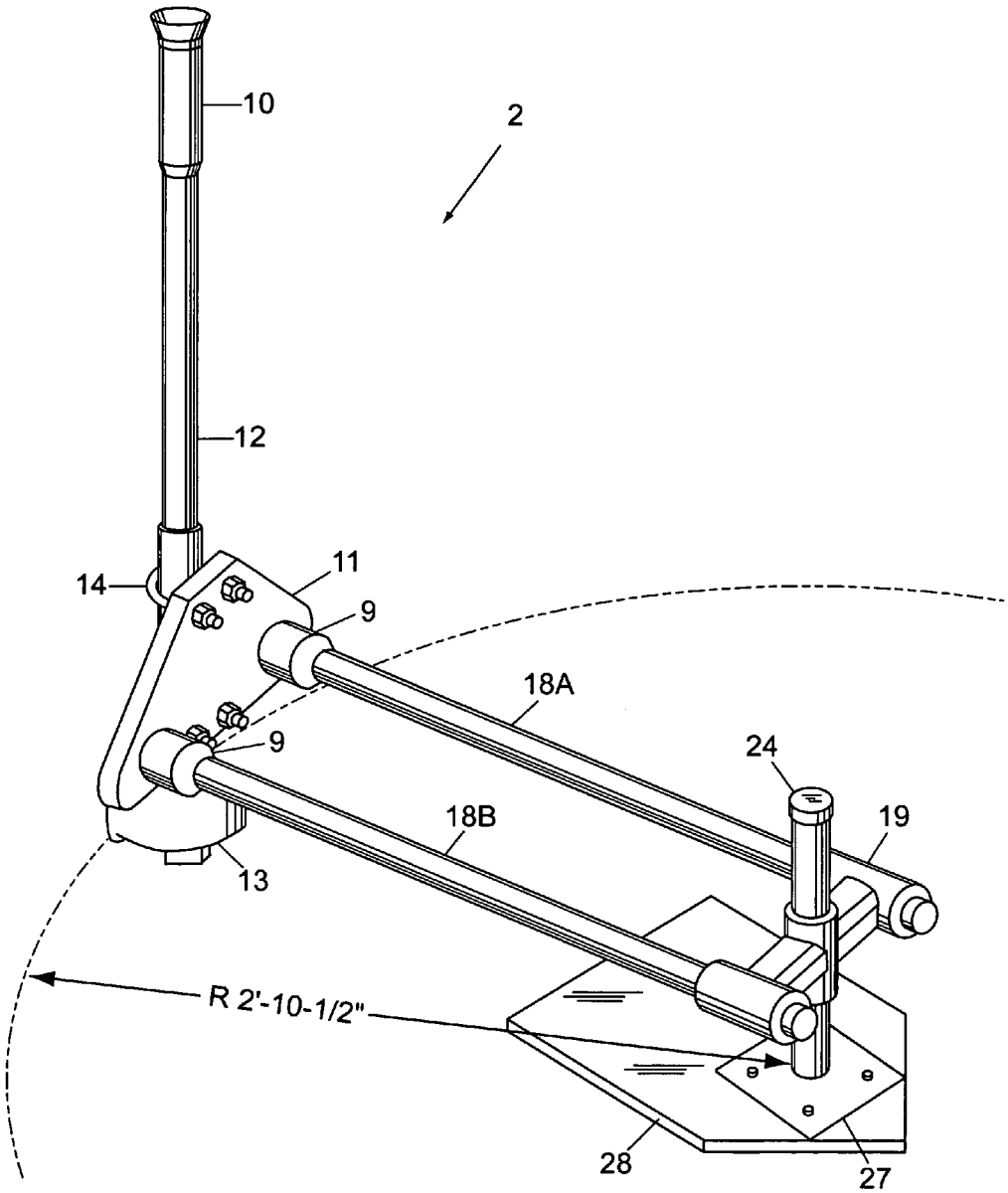
FIG. 1 is a perspective view of the articulating batting tee according to one embodiment of the present invention.

As shown in FIG. 1, the invention is a fully-articulating batting tee 2 that allows the user to position the baseball within a range around home plate.

The batting tee 2 generally includes a corrugated hard rubber ball-mount 10 attached to a telescoping stem 12, which is in turn supported on a round platform 13. The stem 12 is captured by the yokes of two U-couplings 14 which are anchored in a triangular support plate 11. The support plate 11 is carried at the distal end of two parallel lateral struts 18A-B, both of which are inserted into corresponding receptacles 9 that are integrally formed in the rear of the triangular support plate 11. The other ends of the two parallel lateral struts 18A-B are inserted into side-by-side collars of a pivoting coupling 19. The pivoting coupling 19 is pivotally mounted on a downward support 24 that extends downwardly for ground support. The rear downward support 24 is vertically supported on a base plate 27, which is in turn screwed to a conventional rubber home plate 28. The entire above-described structure may be constructed substantially with existing PVC pipe components, although it becomes more economical to integrally mold the components for quantity manufacturing.

Figure 2:
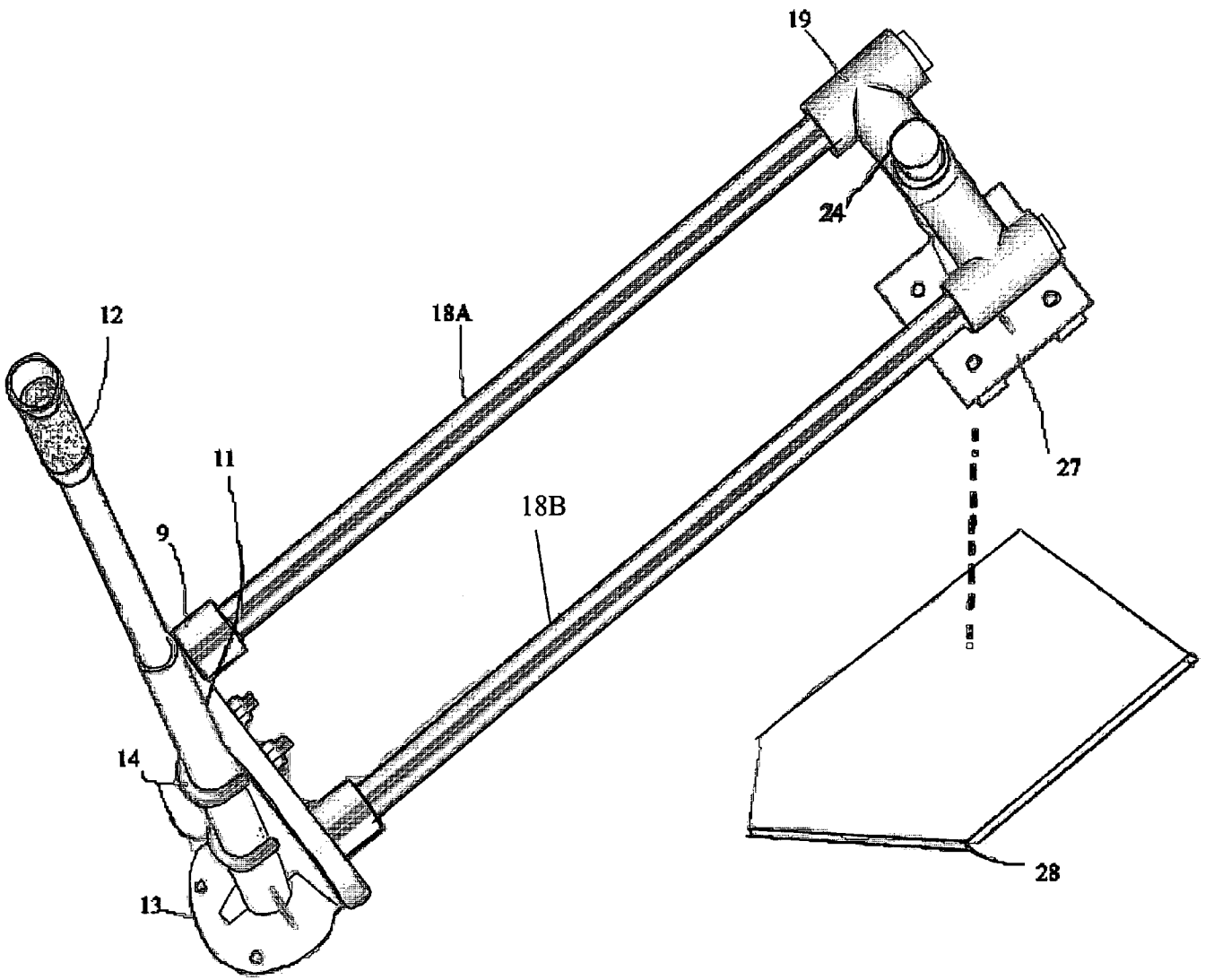
FIG. 2 is a perspective overhead view of the batting tee 2 of FIG. 1.

FIG. 2 is an overhead view of the batting tee 2 of FIG. 1.

The corrugated hard rubber ball-mount 10 is a commercially-available component used with virtually all batting tees. Ball-mount 10 is inserted onto the telescoping stem 12, which comprises two telescoping lengths of hard tubing (adjustable from approx. 18" to 3'). Stem 12 is in turn joined to round platform 13 for vertical support. The stem 12 is then attached to triangular support plate 11 by the two vertically-spaced U-couplings 14, which are bolted through the support plate 11. The support plate 11 is then mounted on the distal end of the two parallel lateral struts 18A-B via receptacles 9, and the other ends of the two parallel lateral struts 18A-B are inserted into side-by-side collars of pivoting coupling 19. The pivoting coupling 19 is then rotatably inserted on the downward support 24, and the base plate 27 is attached to a conventional rubber home plate 28. It will be appreciated by those skilled in the art that the foregoing components may be combined and integrally molded as desired without departing from the scope or spirit of the invention.

In operation, the batting tee is fully articulated as follows.

Lateral (in-or-out) adjustment is attained by sliding the parallel lateral struts 18A-B in and/or out through the collars of the pivoting coupling 19, thereby positioning the ball-mount 10 within any desired radius from the base plate 28 (from 2'-10" to none at all). In addition, the ball can be moved front-to-back and/or side-to-side by pivoting the coupling 19 around base plate 28. Finally, the height of the ball can be adjusted by telescoping stem 12 as desired. The foregoing adjustment options provide a fully articulating batting tee that can position the ball anywhere over or around home plate. This allows positioning of the ball with respect to the vertex of the batter's swing, and provides a more realistic hitting situation than conventional batting tees.

Figure 3:
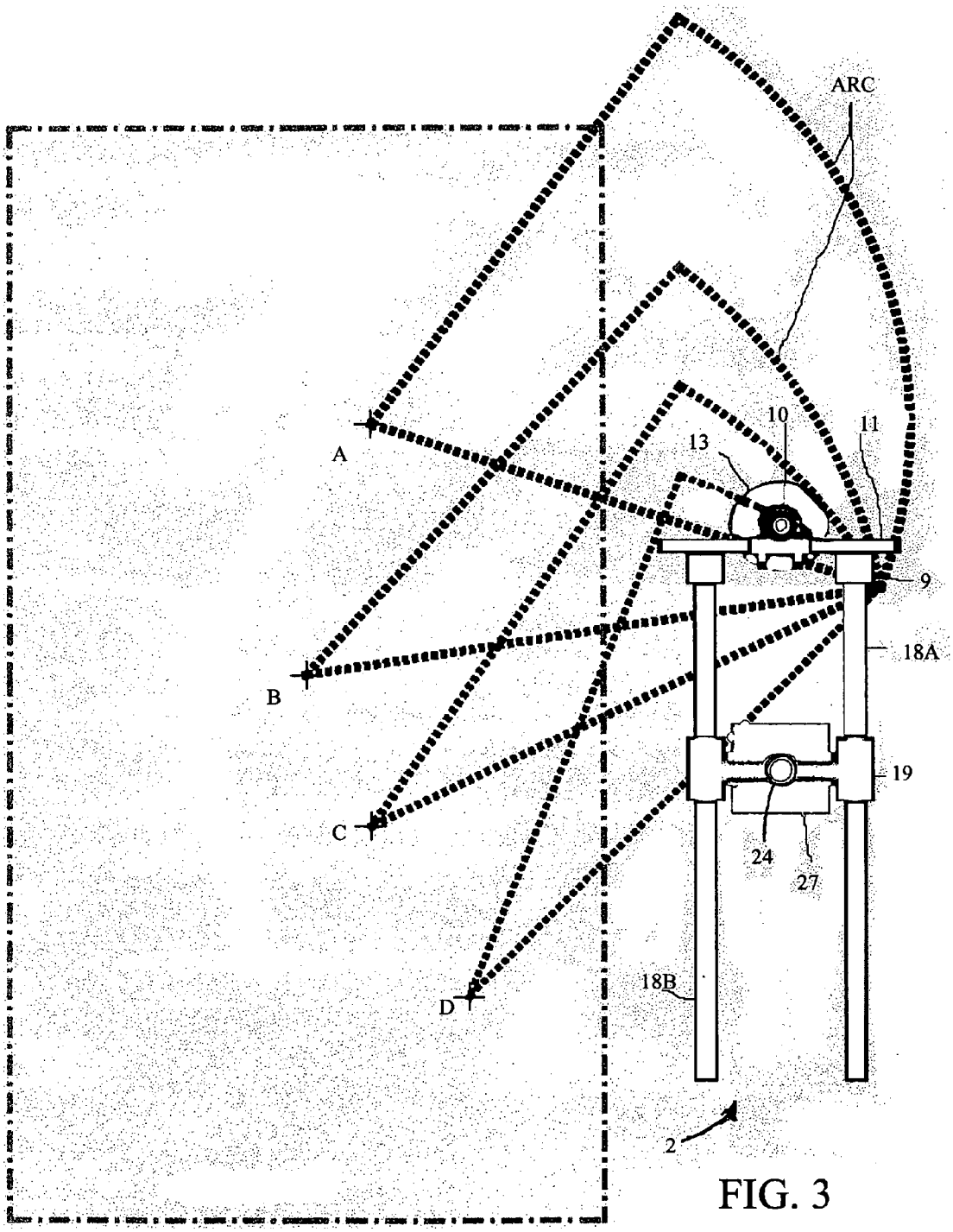
FIG. 3 is an overhead view illustrating the mechanical potential of a fully articulating batting tee.

FIG. 3 illustrates the present batting tee 2 relative to the batter's hitting arc, which shows that the tee provides a more realistic hitting situation than conventional batting tees. Specifically, the batter will position himself/herself as desired within the batter's box BB at a given point, for example, points A-D. The arc of the batter's swing depends on the chosen position. For example, positioning oneself toward the front of the batter's box at point A will result in an open swing arc at the point of ball contact, while positioning oneself toward the back of the batter's box at point D will result in a closed swing arc at the point of ball contact. In each such case, for every chosen position in the batter's box, the ball-mount 10 can be positioned: 1) at the proper radius from the base plate 28 by adjusting struts 18A & B; and 2) at the proper front-to-back position by pivoting the coupling 19 around base plate 28. The foregoing adjustment options ensure that the batter can position the ball in the "sweet spot", with respect to the vertex of the batter's swing, so that the batter can familiarize himself with hitting the ball half way between the two vibration nodes of the bat (and can realize the feel of hitting at the center of percussion wherein both vibration nodes are minimally excited).

Moreover, the above-described batting tee 2 is structurally superior and can withstand repeated mishits by virtue of its redundant support structure. Specifically, a two-point ground support is provided by the combination of round platform 13 (directly beneath the ball) which is pivotally offset from base plate 28. In addition, the pivotal offset of the telescoping stem 12 from downward support 24 is accomplished by two parallel lateral struts 18A-18B. This doubly-reinforced lateral structure adds great lateral stability to the device.

Again, one skilled in the art would understand that the entire above-described structure may be constructed with existing PVC pipe components substantially as shown and described, or discrete components can be combined and integrally molded for more economical manufacturing.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

I claim:

1. An articulated batting tee, comprising:

a first support post including a telescoping stem for height-adjustable support of a baseball, and a ground support platform for resting said first support post on the ground;

a mounting plate attached to said first support post, said mounting plate including a pair of receptacles;

a lateral support assembly comprising a pair of parallel lateral struts each inserted at one end into a corresponding receptacle of said pair on the mounting plate;

a base plate;

a second support post mounted on said base plate;

a pivoting coupling mounted on said second support post, said pivoting coupling including a pair of collars, another end of each of said parallel lateral struts being slidably inserted into a corresponding collar of said pair through said pivoting coupling for lateral adjustment;

whereby a combination of said height-adjustment, lateral adjustment and pivoting provide a fully articulating batting tee that can position a ball anywhere over or around said practice plate.

2. The articulated batting tee according to claim 1, further comprising a corrugated rubber ball mount atop said telescoping stem.

3. The articulated batting tee according to claim 1, wherein the mounting plate attached to said first support post comprises a vertical plate with horizontal pair of receptacles for insertion of the parallel struts.

4. The articulated batting tee according to claim 1, wherein the mounting plate is attached to said first support post by a pair of U-couplings.

5. The articulated batting tee according to claim 1, wherein the pivoting coupling, mounting plate, and parallel struts are all formed from PVC plastic.

6. An articulated batting tee, comprising:

a first support post including a telescoping stem for height-adjustable support of a baseball, said telescoping stem extending downwardly to a first point of ground-support;

a mounting plate attached to said first support post, said mounting plate including a pair of receptacles;

a lateral support assembly comprising a plurality of lateral struts joined at one end to said receptacles of the mounting plate on said first support post;

a second support post having a pivoting coupling mounted thereon, said pivoting coupling having a plurality of collars each for slidably supporting a corresponding one of said lateral struts; and a practice plate, said second support post being pivotally coupled at another end to said practice plate and thereby providing a second point of ground-support;

whereby a combination of said height-adjustment, lateral adjustment and pivoting provide a fully articulating batting tee that can position a ball anywhere over or around said practice plate.

7. The articulated batting tee according to claim 6, further comprising a corrugated rubber ball mount atop said telescoping stem.

8. The articulated batting tee according to claim 6, wherein the mounting plate attached to said first support post comprises a vertical plate with a horizontal pair of receptacles for insertion of the parallel struts.

9. The articulated batting tee according to claim 6, wherein the mounting plate is attached to said first support post by a pair of U-couplings.

10. The articulated batting tee according to claim 6, wherein the pivoting coupling, mounting plate, and parallel struts are all formed from PVC plastic.

* * * * *